US008994627B2

(12) United States Patent
Kim et al.

(10) Patent No.: US 8,994,627 B2
(45) Date of Patent: Mar. 31, 2015

(54) LIQUID CRYSTAL DISPLAY

(75) Inventors: Minwoo Kim, Yongin-si (KR); Minhyung Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 976 days.

(21) Appl. No.: 12/049,154

(22) Filed: Mar. 14, 2008

(65) Prior Publication Data

US 2008/0266219 A1 Oct. 30, 2008

(30) Foreign Application Priority Data

Apr. 27, 2007 (KR) ..... 10-2007-0041270

(51) Int. Cl.
*G09G 3/36* (2006.01)

(52) U.S. Cl.
CPC ..... *G09G 3/3674* (2013.01); *G09G 3/3655* (2013.01); *G09G 2300/0426* (2013.01); *G09G 2320/0223* (2013.01); *G09G 2320/0233* (2013.01); *G09G 2320/0257* (2013.01)
USPC ..... 345/87; 345/88; 345/90; 345/92

(58) Field of Classification Search
USPC ..... 345/87
See application file for complete search history.

(56) References Cited

U.S. PATENT DOCUMENTS 5,311,342 A * 5/1994 Watanabe ..... 349/152
6,037,923 A 3/2000 Suzuki
2003/0095091 A1 5/2003 Enomoto et al.
2004/0066363 A1* 4/2004 Yamano et al. ..... 345/98
2004/0178977 A1 9/2004 Nakayoshi et al.
2004/0263743 A1* 12/2004 Kim et al. ..... 349/139
2007/0057257 A1 3/2007 Kim
2007/0091044 A1* 4/2007 Park et al. ..... 345/88

FOREIGN PATENT DOCUMENTS

EP 1 492 078 A2 12/2004
JP 4-269789 9/1992
JP 9258243 A 10/1997
JP 2001-194685 7/2001
JP 2004-117707 A 4/2004
JP 2006-171022 6/2006
JP 2007-079568 A 3/2007
KR 10-2005-0001249 1/2005

OTHER PUBLICATIONS

Patent Abstracts of Japan, Publication No. 04-269789, dated Sep. 25, 1992, in the name of Kenichi Kondo.

(Continued)

*Primary Examiner* — Jesus Hernandez
(74) *Attorney, Agent, or Firm* — Christie, Parker & Hale, LLP

(57) ABSTRACT

A liquid crystal display includes data lines extending in a first direction, gate lines extending in a second direction between a first side and a second side of the liquid crystal display and crossing the data lines, and common voltage lines crossing the data lines and parallel with the gate lines. The gate lines include even gate lines coupled to a gate driver at near the first side and odd gate lines coupled to the gate driver at near the second side. The common voltage lines include even common voltage lines coupled to a common voltage supplier at near the second side and odd common voltage lines coupled to the common voltage supplier at near the first side.

19 Claims, 7 Drawing Sheets

(56) References Cited

OTHER PUBLICATIONS

Korean Patent Abstracts, Publication No. 1020050001249, dated Jan. 6, 2005, in the name of Kyong Seok Kim et al.
European Search Report dated Jul. 16, 2008 for EP08155181.4.
Japanese Office action dated Feb. 15, 2011, for corresponding Japanese Patent application 2007-233036.
Patent Abstracts of Japan and English machine translation of Japanese Publication 2001-194685, 12 pages.
Patent Abstracts of Japan and English machine translation of Japanese Publication 2006-171022, 20 pages.
JPO Notice of Allowance dated Feb. 7, 2012 for JP 2007-233036 (3 pages).
Machine English Translation of JP 2004-117707 A (17 pages).

* cited by examiner

LIQUID CRYSTAL DISPLAY

CROSS-REFERENCE TO RELATED APPLICATIONS

This application claims priority to and the benefit of Korean Patent Application No. 10-2007-0041270, filed on Apr. 27, 2007, the entire content of which is incorporated herein by reference.

BACKGROUND OF THE INVENTION

1. Field of the Invention

The present invention relates to a liquid crystal display.

2. Description of the Related Art

A conventional liquid crystal display portrays images by controlling the light transmittance of liquid crystal using an electric field. To this end, the liquid crystal display includes a liquid crystal panel in which liquid crystal elements are arranged in a matrix form and a driving circuit for driving the liquid crystal display panel. In the liquid crystal display 100 as illustrated in FIG. 1, a liquid crystal display panel 140, in which data lines Data [1] to Data [m] coupled to a data driver 120 and gate lines Gate [1] to Gate [n] coupled to a gate driver 110 are crossed, is provided with thin film transistors (TFTs) for driving liquid crystal elements $C_{LC}$ at the crossed portions. The liquid crystal display panel is further provided with storage capacitors $C_{st}$ for maintaining the voltage of the liquid crystal element $C_{LC}$. The liquid crystal element $C_{LC}$ controls the amount of light transmitted or shields light by changing the arrangement of liquid crystal molecules with an electric field in a liquid crystal layer therein. The electric field is generated when data voltage is applied to a pixel electrode 141 from the data driver 120 and common voltage Vcom is applied from a common voltage supplier 130.

In the liquid crystal display 100, the common voltage line is formed in a short structure within the liquid crystal display panel. When the common voltage is applied to a common electrode 142 and the gate voltage is input to apply the data voltage to the pixel electrode 141, the storage capacitor $C_{st}$, coupled between the common electrode 142 and the pixel electrode 141, charges an amount of charge corresponding to the voltage difference therebetween. However, while the gate voltage moves from the left-most pixel to the right-most pixel, a delay error occurs so that an error between the data voltage value applied to the pixel electrode at a left end and the data voltage value applied to the pixel electrode at a right end occurs due to the delay. In order to minimize the delay error, the common voltage is applied to both ends of the liquid crystal display by shorting both ends of the common voltage line. Presently, the delay error does not occur in the first pixel or the last pixel. However, the delay error occurs in the pixel coupled to a central column, that is, a data line Data [m/2]. Even though the common voltage is applied at both ends of the common voltage line, each pixel becomes more asymmetrical in the amount of charge the closer the pixel is to the central column of the liquid crystal display. An afterimage occurs due to asymmetrical amounts of charge when a pattern changes, and the remaining voltage occurs due to the unnecessary amount of charge.

SUMMARY OF THE INVENTION

The present invention relates to a liquid crystal display. In an aspect according to an exemplary embodiment, a liquid crystal display may prevent or reduce generation of afterimage phenomena and remaining voltage caused by non-uniform amounts of charge in each of the pixels by uniformly maintaining the charge in the pixels.

In one exemplary embodiment according to the present invention, there is provided a liquid crystal display including a plurality of data lines extending in a first direction, a gate driver for supplying a gate voltage, a common voltage supplier for supplying a common voltage, a plurality of gate lines extending in a second direction between a first side and a second side of the liquid crystal display and crossing the data lines, the gate lines including even gate lines and odd gate lines, the even gate lines coupled to the gate driver at a location proximate to the first side and the odd gate lines coupled to the gate driver at a location proximate to the second side, and a plurality of common voltage lines crossing the data lines and parallel with the gate lines, the common voltage lines including even common voltage lines and odd common voltage lines, the odd common voltage lines coupled to the common voltage supplier at a location proximate to the first side and the even common voltage lines coupled to the common voltage supplier at a location proximate to the second side.

The odd gate lines may be configured to transfer the gate voltage from near the second side toward the first side and the even gate lines may be configured to transfer the gate voltage from near the first side toward the second side.

The odd common voltage lines may be configured to transfer common voltage from near the first side toward the second side and the even common voltage lines may be configured to transfer the common voltage from near the second side toward the first side.

The odd gate lines may be configured to transfer the gate voltage from near the first side toward the second side and the even gate lines may be configured to transfer the gate voltage from near the second side toward the first side.

The odd common voltage lines may be configured to transfer the common voltage from near the second side toward the first side and the even common voltage lines may be configured to transfer the common voltage from near the first side toward the second side.

The liquid crystal display may further include a plurality of pixels, each of the plurality of pixels coupled to one of the plurality of data lines, one of the plurality of gate lines, and one of the plurality of common voltage lines, and configured to receive the data voltage, the gate voltage, and the common voltage to operate a liquid crystal element therein.

Each of the plurality of pixels may be located at an area where said one of the plurality of data lines is orthogonal to said one of the plurality of gate lines and said one of the plurality of common voltage lines.

Each of the plurality of pixels may include a thin film transistor coupled between said one of the plurality of data lines and a pixel electrode, a liquid crystal element coupled between the pixel electrode and a common electrode, and a storage capacitor coupled between the pixel electrode and the common electrode.

The thin film transistor may include a control electrode coupled to said one of the plurality of gate lines, a first electrode coupled to said one of the plurality of data lines, and a second electrode coupled to the pixel electrode.

The thin film transistor may be turned on when the gate voltage is applied to the control electrode to apply the data voltage to the pixel electrode.

The common electrode may be coupled to said one of the plurality of common voltage lines.

The gate voltage supplied by the even gate lines may be applied from near the first side toward the second side and the common voltage supplied by the even common voltage lines may be applied from near the second side toward the first side to compensate for each other such that an amount of charge remains substantially uniform in each of the plurality of pixels.

The gate voltage supplied by the odd gate lines may be applied from near the second side toward the first side and the common voltage supplied by the odd common voltage lines may be applied from near the first side toward the second side to compensate for each other such that the amount of charge remains substantially uniform in each of the plurality of pixels.

The amount of charge may remain substantially uniform in the pixels near the first side and coupled to the even gate lines and the even common voltage lines, the gate voltage compensating for a delay of the common voltage supplied to the pixels near the first side.

The amount of charge remains substantially uniform in the pixels near the second side and coupled to the even gate lines and the even common voltage lines, the common voltage compensating for a delay of the gate voltage supplied to the pixels near the second side.

The amount of charge may remain substantially uniform in the pixels near the first side and coupled to the odd gate lines and the odd common voltage lines, the common voltage compensating for a delay of the gate voltage supplied to the pixels near the first side.

The amount of charge may remain substantially uniform in the pixels near the second side and coupled to the odd gate lines and the odd common voltage lines, the gate voltage compensating for a delay of the common voltage supplied to the pixels near the second side.

In another exemplary embodiment according to the present invention, there is provided a liquid crystal display including a plurality of data lines extending in a first direction, a plurality of gate lines extending in a second direction between a first side and a second side of the liquid crystal display and crossing the data lines, the gate lines including even gate lines and odd gate lines, the even gate lines coupled to a gate driver at a location proximate to the second side and the odd gate lines coupled to the gate driver at a location proximate to the first side, a plurality of common voltage lines crossing the data lines and parallel with the gate lines, the common voltage lines including even common voltage lines and odd common voltage lines, the odd common voltage lines coupled to a common voltage supplier at a location proximate to the second side and the even common voltage lines coupled to the common voltage supplier at a location proximate to the first side, and a plurality of pixels, each of the plurality of pixels coupled to one of the plurality of data lines, one of the plurality of gate lines, and one of the plurality of common voltage lines and configured to receive a data voltage, a gate voltage, and a common voltage to operate a liquid crystal element therein.

The gate voltage supplied by the even gate lines may be applied from near the second side toward the first side and the common voltage supplied by the even common voltage lines may be applied from near the first side toward the second side to compensate for each other such that an amount of charge remains substantially uniform in each of the plurality of pixels.

The gate voltage supplied by the odd gate lines may be applied from near the first side toward the second side and the common voltage supplied by the odd common voltage lines may be applied from near the second side toward the first side to compensate for each other such that an amount of charge remains substantially uniform in each of the plurality of pixels.

The liquid crystal display according to embodiments of the present invention as described above may prevent or reduce generation of afterimage phenomena and remaining voltage caused by non-uniform amounts of charge in each of the pixels by substantially uniformly maintaining the charge in the pixels.

BRIEF DESCRIPTION OF THE DRAWINGS

The above and other aspects and features of the present invention will be more apparent from the following detailed description taken in conjunction with the accompanying drawings, in which.

DETAILED DESCRIPTION

Figure 1:
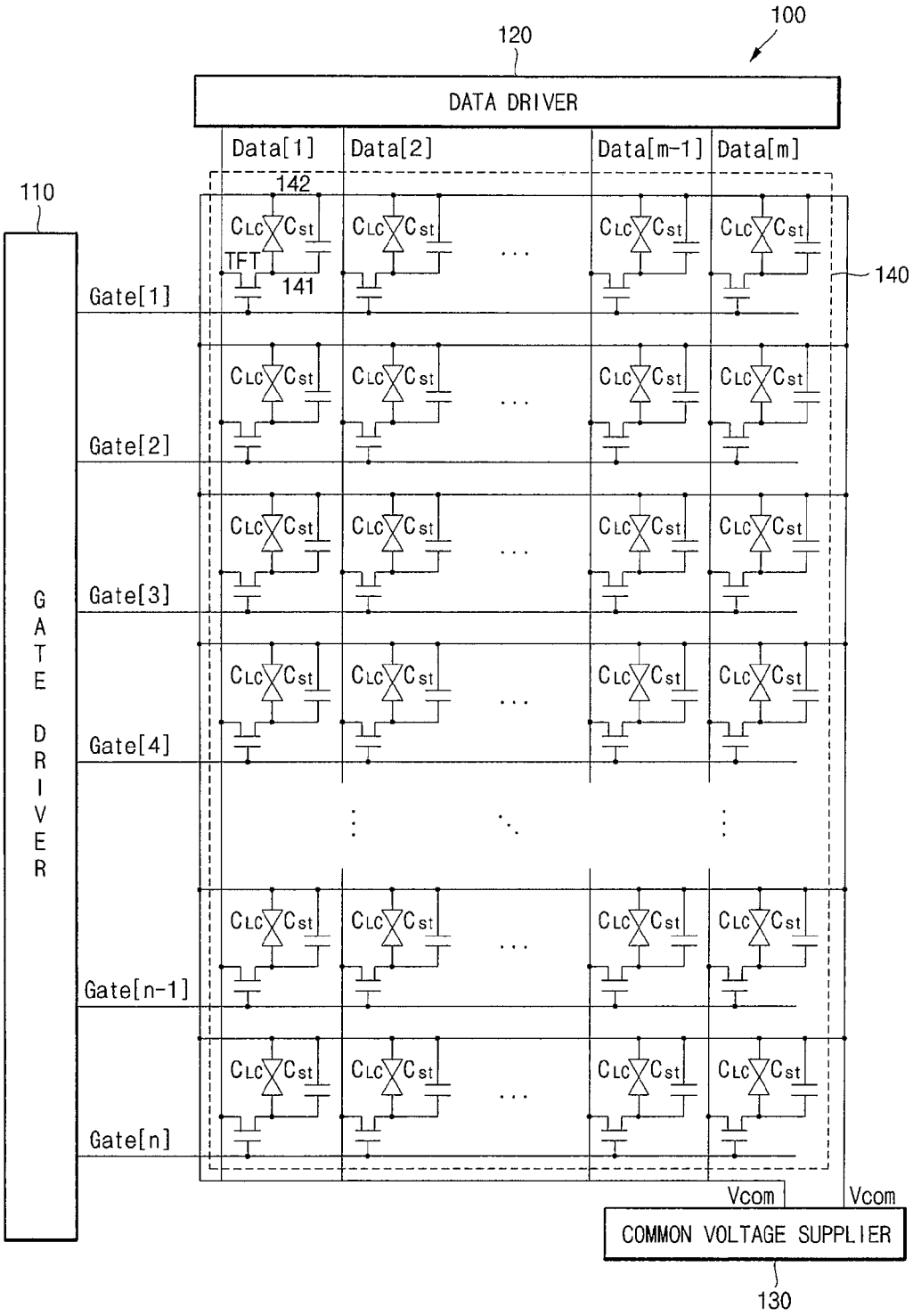
FIG. 1 PRIOR ART
FIG. 1 is a block diagram illustrating a conventional liquid crystal display.

Hereinafter, the embodiment of the present invention will be described in more detail with reference to the accompanying drawings so that those skilled in the art can readily implement the embodiments of the present invention.

Herein, like reference numerals indicate portions having like constitutions and operations throughout the specification. Also, when a certain portion is described as being coupled to other portions, the portion may be directly coupled or may be indirectly coupled via one or more other portions therebetween, and may include physical coupling and/or electrical coupling.

Figure 2:
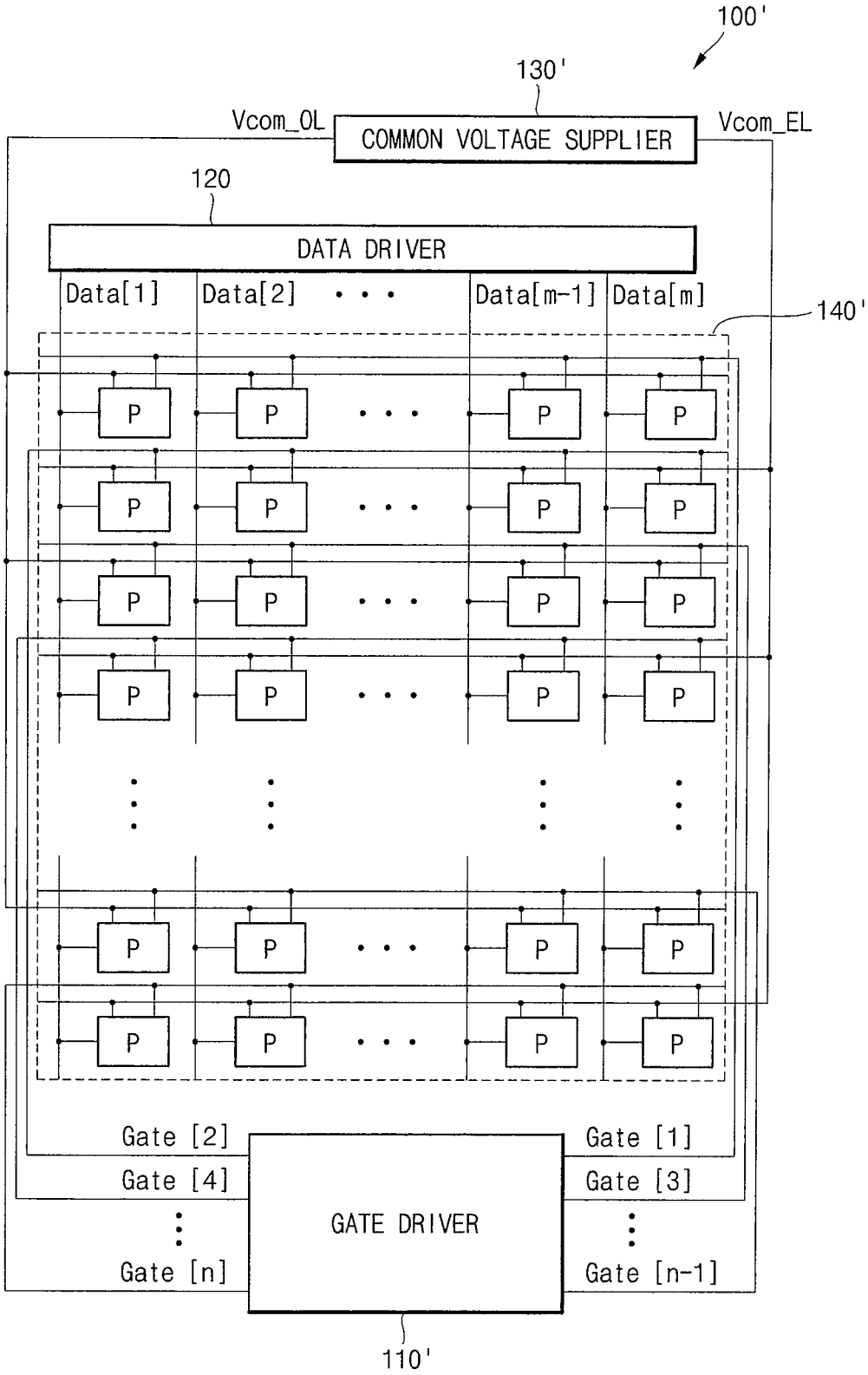
FIG. 2 is a block diagram illustrating a liquid crystal display according to one embodiment of the present invention.

Referring to FIG. 2, there is illustrated a liquid crystal display according to one embodiment of the present invention.

In FIG. 2, the liquid crystal display 100' includes a gate driver 110', a data driver 120, a common voltage supplier 130', and a liquid crystal display panel 140'.

The data driver 120 supplies a data voltage to the liquid crystal display panel 140' through a plurality of data lines Data [1], Data [2], . . . , Data [m]. The plurality of data lines Data [1], Data [2], . . . , Data [m] are extended in a first direction in the liquid crystal display panel 140' and coupled to a plurality of pixels. The first direction is vertically oriented in FIG. 2.

The gate driver 110' sequentially supplies a gate voltage to the liquid crystal display panel 140' through a plurality of gate lines Gate [1], Gate [2], . . . , Gate [n]. The plurality of gate lines Gate [1], Gate [2], . . . , Gate [n] are extended in a second direction between a first side (i.e., left side) and a second side (i.e., right side) of the liquid crystal display panel 140', crossing the plurality of data lines and coupled to the plurality of pixels. The second direction is horizontally oriented in FIG. 2. Odd gate lines are configured to transfer the gate voltage from the second side of the liquid crystal display panel proximate to the m data line Data [m] toward the first side of the liquid crystal display panel proximate to the first data line Data [1]. Even gate lines are configured to transfer the gate voltage from the first side of the liquid crystal display panel proximate to the first data line Data [1] toward the second side of the liquid crystal display panel proximate to the m data line Data [m]. In other words, the odd gate lines apply the gate voltage from the pixels coupled to the m data line Data [m] to the pixels coupled to the first data line Data [1], and the even gate lines apply the gate voltage from the pixels coupled to the first data line Data [1] to the pixels coupled to the m data line Data [m]. In the pixels coupled to the odd gate lines, the delay time of the gate voltage applied to the pixels coupled to the m data line Data [m] is shortest and the delay time of the gate voltage applied to the pixels coupled to the first data line Data [1] is longest. In the pixels coupled to the even gate lines, the delay time of the gate voltage applied to the pixels coupled to the first data line Data [1] is shortest and the delay time of the gate voltage applied to the pixels coupled to the m data line Data [m] is longest.

The common voltage supplier 130' generates common voltage Vcom that is a reference voltage at the time of operating the liquid crystal cells and supplies the common voltage through common voltage lines Vcom_OL (odd common voltage lines) and Vcom_EL (even common voltage lines). The common voltage lines Vcom_OL and Vcom_EL are extended in the second direction in the liquid crystal display panel 140' and coupled to the plurality of pixels. The odd common voltage lines Vcom_OL are configured to transfer the common voltage from the first side of the liquid crystal display panel proximate to the first data line Data [1] toward the second side of the liquid crystal display panel proximate to the m data line Data [m], and the even common voltage lines Vcom_EL are configured to transfer the common voltage from the second side of the liquid crystal display panel proximate to the m data line Data [m] toward the first side of the liquid crystal display panel proximate to the first data line Data [1]. In other words, the odd common voltage line Vcom_OL apply the common voltage from the pixels coupled to the first data line Data [1] to the pixels coupled to the m data line Data [m], and the even common voltage lines Vcom_EL apply the common voltage from the pixels coupled to the m data line Data [m] to the pixels coupled to the first data line Data [1]. In the pixels coupled to the odd common voltage lines Vcom_OL, the delay time of the common voltage applied to the pixels coupled to the first data line Data [1] is shortest and the delay time of the common voltage applied to the pixels coupled to the m data line Data [m] is longest. In the pixels coupled to the even common voltage lines Vcom_EL, the delay time of the common voltage applied to the pixels coupled to the first data line Data [1] is longest and the delay time of the common voltage applied to the pixels coupled to the m data line Data [m] is shortest.

The liquid crystal display panel 140' includes the plurality of data lines Data [1], Data [2], . . . , Data [m], which are extended in the first direction, the plurality of gate lines Gate [1], Gate [2], . . . , Gate [n] and the common voltage lines Vcom_OL, Vcom_EL, which are extended in the second direction, and the pixels P defined by the plurality of gate lines Gate [1], Gate [2], . . . , Gate [n], the common voltage lines Vcom_OL, Vcom_EL and the plurality of data lines Data [1], Data [2], . . . , Data [m].

Here, each of the pixels may be formed in a pixel region defined by two neighboring gate lines (or common voltage lines) and two neighboring data lines. As described above, the gate lines Gate [1], Gate [2], . . . , Gate [n] may be supplied with the gate voltage from the gate driver 110', the data lines Data [1], Data [2], . . . , Data [m] may be supplied with the data voltage from the data driver 120 and the common voltage lines Vcom_OL, Vcom_EL may be supplied with the common voltage from the common voltage driver 130'.

Figure 3:
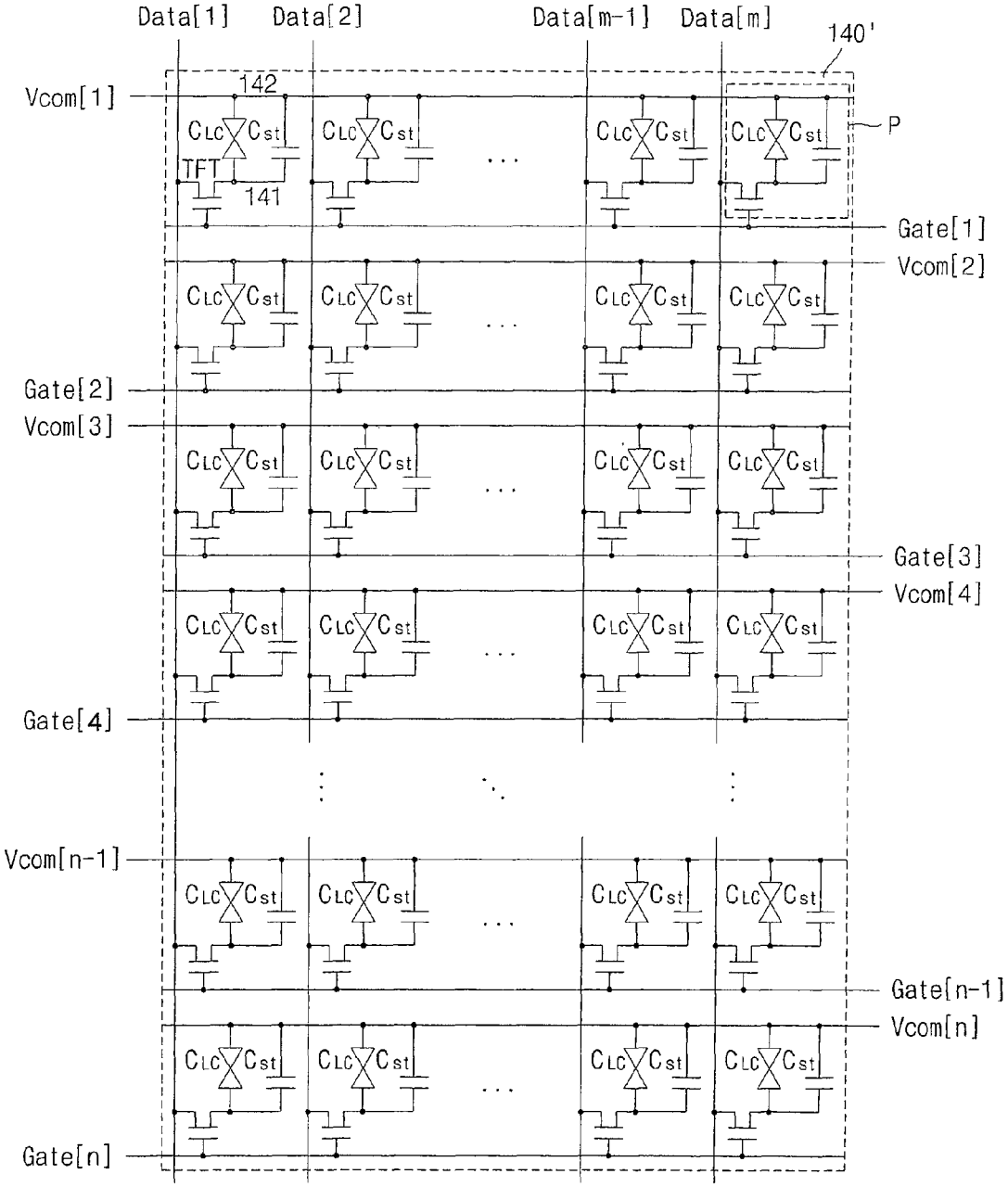
FIG. 3 is a circuit diagram illustrating the pixels on the liquid crystal display of FIG. 2 as an equivalent circuit.

Referring to FIG. 3, there is presented a circuit diagram illustrating the pixels on the liquid crystal display of FIG. 2 as an equivalent circuit.

Each of the plurality of pixels on the liquid crystal display of FIG. 3 includes a thin film transistor, a liquid crystal element $C_{LC}$ and a storage capacitor $C_{st}$.

The thin film transistor (hereinafter, referred to as "TFT") includes a gate electrode, a first electrode and a second electrode. The gate electrode is coupled to a corresponding one of the plurality of gate lines Gate [1], Gate [2], . . . , Gate [n], the first electrode (a drain electrode or a source electrode) is coupled to a corresponding one of the plurality of data lines Data [1], Data [2], . . . , Data [m], and the second electrode (a source electrode or a drain electrode) is coupled to a pixel electrode 141. The TFT is turned on when a high level of gate voltage is applied to the gate electrode to transfer the data voltage from the data lines Data [1], Data [2], . . . , Data [m] to the pixel electrode 141.

The liquid crystal element $C_{LC}$ includes a first electrode and a second electrode. The first electrode is coupled to the pixel electrode 141 and the second electrode is coupled to a common electrode 142. The liquid crystal element $C_{LC}$ controls the amount of light transmitted or shields light by changing the arrangement of liquid crystal molecules with an electric field in a liquid crystal layer therein. The electric field is generated when the data voltage is applied to the pixel electrode 141 and the common voltage Vcom is applied from the common voltage supplier 130'.

The storage capacitor $C_{st}$ includes a first electrode and a second electrode. The first electrode is coupled to the pixel electrode 141 and the second electrode is coupled to the common electrode 142. In other words, the storage capacitor $C_{st}$ is coupled to the liquid crystal element $C_{LC}$ in parallel. When a high level of gate voltage is applied to the gate electrode of the TFT, the TFT is turned on. When the TFT is turned on, the data voltage is applied to the pixel electrode 141 and the storage capacitor $C_{st}$ stores an amount of charge equal to the voltage difference between the pixel electrode 141 and the common electrode 142. When the TFT is turned off, the amount of charge that was previously stored in the storage capacitor $C_{st}$ is supplied to the pixel electrode 141, thereby maintaining the operation of the liquid crystal element.

Figure 4A:
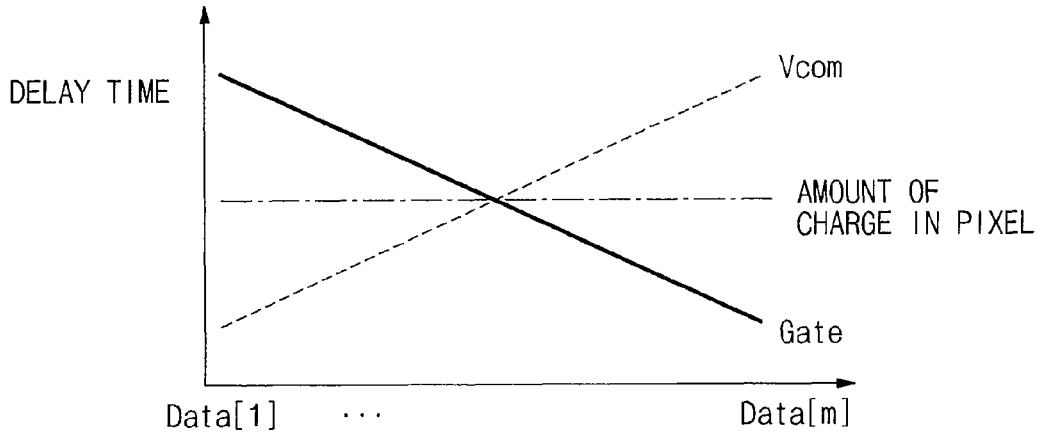
FIG. 4*a* is a graph illustrating the relationship between a data line coupled to odd pixels in the liquid crystal display of FIG. 2 and the amount of charge in the odd pixels.
Figure 4B:
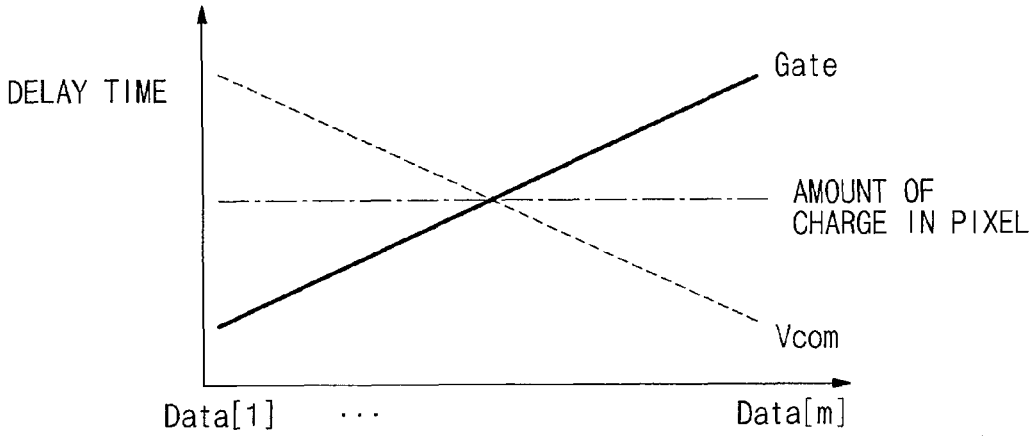
FIG. 4*b* is a graph illustrating the relationship between a data line coupled to even pixels in the liquid crystal display of FIG. 2 and the amount of charge in the even pixels.

Referring to FIGS. 4*a* and 4*b*, there are presented graphs illustrating the relationship between the data line coupled to the pixel in the liquid crystal display of FIG. 2 and the amount of charge in the pixel.

FIG. 4*a* is a graph illustrating the amount of charge in the odd pixels coupled to the odd gate lines Gate [1], Gate [3], . . . , Gate [n−1]. The pixels are coupled to the data lines Data [1], Data [2], . . . , Data [m] extending in a first direction and the odd gate lines Gate [1], Gate [3], . . . , Gate [n−1] and the odd common voltage lines Vcom_OL extending in a second direction between the first side and the second side of the liquid crystal display and crossing the plurality of data lines. Here, the odd gate lines extend from near the second side toward the first side, and the odd common voltage lines Vcom_OL extend from near the first side toward the second side.

Referring to the amount of charge in the odd pixels, the delay time of the gate voltage applied to the pixels coupled to the first data line Data [1] is longer than that of the gate voltage applied to the pixels coupled to other data lines Data [2], Data[3], . . . , Data [m], and the delay time of the common voltage is shorter than that of the common voltage applied to the pixels coupled to other data lines Data [2], Data [3], . . . , Data [m]. Additionally, the delay time of the gate voltage applied to the pixels coupled to the m data line Data [m] is shorter than that of the gate voltage applied to the pixels coupled to other data lines Data [1], Data[2], . . . , Data [m−1], and the delay time of the common voltage is longer than that of the common voltage applied to the pixels coupled to other data lines Data [1], Data [2], . . . , Data [m−1].

Here, the difference between the delay time of the gate voltage applied to the pixels coupled to the first data line Data [1] and the delay time of the gate voltage applied to the pixels coupled to the m data line Data [m] is substantially the same as the difference between the delay time of the common voltage applied to the pixels coupled to the first data line Data [1] and the delay time of the common voltage applied to the pixels coupled to the m data line Data [m]. In other words, the delay time of the gate voltage applied to the pixels coupled to the first data line Data [1] is compensated by the delay time of the common voltage. Likewise, the delay time of the common voltage applied to the pixels coupled to the m data line Data [m] is compensated by the delay time of the gate voltage so that each of the pixels has substantially the same amount of charge. Accordingly, the delay time of the gate voltage and the delay time of the common voltage mutually compensate for each other for each of the pixels coupled to any of the plurality of data lines. The pixels having substantially the same amount of charge may prevent or reduce afterimage phenomena and remaining voltage caused by non-uniform amounts of charge in the pixels. In one embodiment, since the common voltage lines Vcom_OL and the odd gate lines Gate [1], Gate [3], . . . , Gate [n−1] use the same metal line with the same delay characteristics during fabrication, the delay time corresponding to the distance is substantially the same.

FIG. 4*b* is a graph illustrating the amount of charge in the even pixels coupled to the even gate lines Gate [2], Gate [4], . . . , Gate [n]. The pixels are coupled to the plurality of data lines extending in the first direction and the even gate lines and the even common voltage lines Vcom_EL extending in the second direction between the first side and the second side of the liquid crystal display and crossing the plurality of data lines. Here, the even gate lines extend from near the first side toward the second side, and the even common voltage lines Vcom_EL extend from near the second side toward the first side.

Referring to the amount of charge in the even pixels, the delay time of the gate voltage applied to the pixels coupled to the first data line Data [1] is shorter than that of the gate voltage applied to the pixels coupled to other data lines Data [2], Data[3], . . . , Data [m], and the delay time of the common voltage is longer than that of the common voltage applied to the pixels coupled to other data lines Data [2], Data [3], . . . , Data [m]. Additionally, the delay time of the gate voltage applied to the pixels coupled to the m data line Data [m] is longer than that of the gate voltage applied to the pixels coupled to other data lines Data [1], Data[2], . . . , Data [m−1], and the delay time of the common voltage is shorter than that of the common voltage applied to the pixels coupled to other data lines Data [1], Data [2], . . . , Data [m−1].

Here, the difference between the delay time of the gate voltage applied to the pixels coupled to the first data line Data [1] and the delay time of the gate voltage applied to the pixels coupled to the m data line Data [m] is substantially the same as the difference between the delay time of the common voltage applied to the pixels coupled to the first data line Data [1] and the delay time of the common voltage applied to the pixels coupled to the m data line Data [m]. In other words, the delay time of the common voltage applied to the pixels coupled to the first data line Data [1] is compensated by the delay time of the gate voltage. Likewise, the delay time of the gate voltage applied to the pixels coupled to the m data line Data [m] is compensated by the delay time of the common voltage so that each of the pixels has substantially the same amount of charge. Accordingly, the delay time of the gate voltage and the delay time of the common voltage mutually compensate for each other for each of the pixels coupled to any of the plurality of data lines. The pixels having the same amount of charge may prevent or reduce afterimage phenomena as well as remaining voltage caused by non-uniform amounts of charge in the pixels. In one embodiment, since the common voltage lines Vcom_EL and the even gate lines Gate [2], Gate [4], . . . , Gate [n] use the same metal line with the same delay characteristics, the delay time during fabrication corresponding to the distance is substantially the same.

Figure 5:
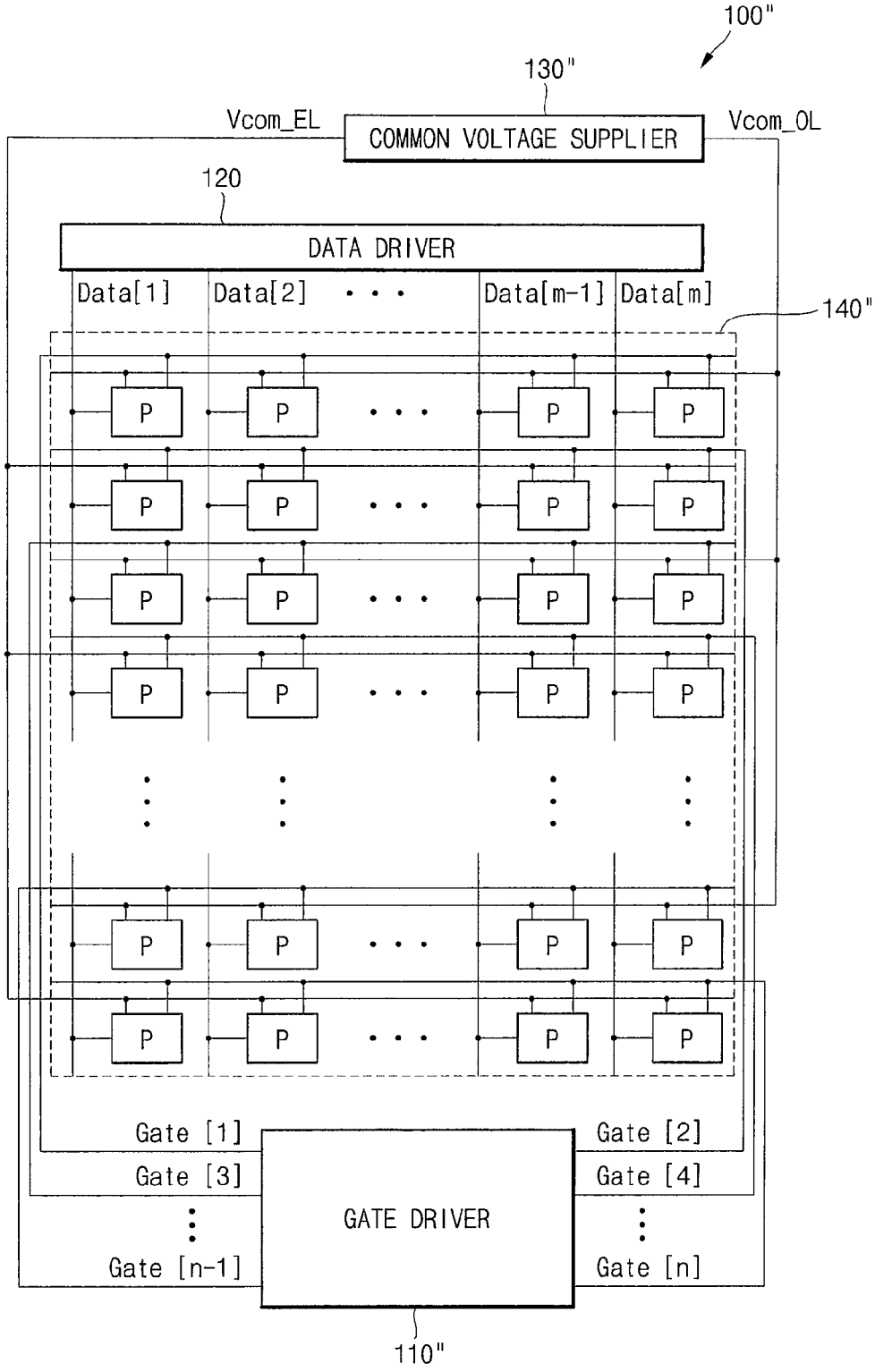
FIG. 5 is a block diagram illustrating a liquid crystal display according to another embodiment of the present invention.

Referring to FIG. 5, there is illustrated a liquid crystal display according to another embodiment of the present invention.

As illustrated in FIG. 5, the liquid crystal display 100" includes gate driver 110", a data driver 120, a common voltage supplier 130", and a liquid crystal display panel 140".

The data driver 120 supplies a data voltage to the liquid crystal display panel 140" through a plurality of data lines Data [1], Data [2], . . . , Data [m]. The plurality of data lines Data [1], Data [2], . . . , Data [m] are extended in a first direction in the liquid crystal display panel 140" and coupled to a plurality of pixels. The first direction may be vertically oriented in FIG. 5.

The gate driver 110" sequentially supplies gate voltage to the liquid crystal display panel 140" through a plurality of gate lines Gate [1], Gate [2], . . . , Gate [n]. The plurality of gate lines Gate [1], Gate [2], . . . , Gate [n] are extended in a second direction between a first side (i.e., left side) and a second side (i.e., right side) of the liquid crystal display panel 140", crossing the plurality of data lines and coupled to the plurality of pixels. The second direction is horizontally oriented in FIG. 5.

Odd gate lines are configured to transfer gate voltage from the first side of the liquid crystal display panel proximate to the first data line Data [1] toward the second side of the liquid crystal display panel proximate to the m data line Data [m], and the even gate lines are configured to transfer the gate voltage from the second side of the liquid crystal display panel proximate to the m data line Data [m] toward the first side of the liquid crystal display panel proximate to the first data line Data [1]. In other words, the odd gate lines therefore apply the gate voltage from the pixels coupled to the first data line Data [1] to the pixels coupled to the m data line Data [m], and the even gate lines apply the gate voltage from the pixels coupled to the m data line Data [m] to the pixels coupled to the first data line Data [1]. In the pixels coupled to the odd gate lines, the delay time of the gate voltage applied to the pixels coupled to the first data line Data [1] is shortest and the delay time of the gate voltage applied to the pixels coupled to the m data line Data [m] is longest. In the pixels coupled to the even gate lines, the delay time of the gate voltage applied to the pixels coupled to the m data line Data [m] is shortest and the delay time of the gate voltage applied to the pixels coupled to the first data line Data [1] is longest.

The common voltage supplier 130" generates common voltage Vcom that is a reference voltage at the time of operating the liquid crystal cells and supplies the common voltage through common voltage lines Vcom_OL (odd common voltage lines) and Vcom_EL (even common voltage lines). The common voltage lines Vcom_OL and Vcom_EL are extended in the second direction in the liquid crystal display panel 140" and coupled to the plurality of pixels.

The odd common voltage lines Vcom_OL are configured to transfer the common voltage from the second side of the liquid crystal display panel proximate to the m data line Data [m] toward the first side of the liquid crystal display panel proximate to the first data line Data [1]. The even common voltage lines Vcom_EL are configured to transfer the common voltage from the first side of the liquid crystal display panel proximate to first data line Data [1] toward the second side of the liquid crystal display panel proximate to the m data line Data [m]. In other words, the odd common voltage lines Vcom_OL apply the gate voltage from the pixels coupled to the m data line Data [m] to the pixels coupled to the first data line Data [1], and the even common voltage lines Vcom_EL apply the common voltage from the pixels coupled to the first data line Data [1] to the pixels coupled to the m data line Data [m]. In the pixels coupled to the odd common voltage lines Vcom_OL, the delay time of the common voltage applied to the pixels coupled to the m data line Data [m] is shortest and the delay time of the common voltage applied to the pixels coupled to the first data line Data [1] is longest. In the pixels coupled to the even common voltage lines Vcom_EL, the delay time of the common voltage applied to the pixels coupled to the m data line Data [m] is longest and the delay time of the common voltage applied to the pixels coupled to the first data line Data [1] is shortest.

The liquid crystal display panel 140" includes the plurality of data lines Data [1], Data [2], . . . , Data [m], which are extended in the first direction, the plurality of gate lines Gate [1], Gate [2], . . . , Gate [n] and the common voltage lines Vcom_OL, Vcom_EL, which are extended in the second direction, and the pixels P defined by the plurality of gate lines Gate [1], Gate [2], . . . , Gate [n], the common voltage lines Vcom_OL, Vcom_EL and the plurality of data lines Data [1], Data [2], . . . , Data [m].

Here, each of the pixels may be formed in a pixel region defined by two neighboring gate lines (or common voltage lines) and two neighboring data lines. As described above, the gate lines Gate [1], Gate [2], . . . , Gate [n] may be supplied with the gate voltage from the gate driver 110", the data lines Data [1], Data [2], . . . , Data [m] may be supplied with the data voltage from the data driver 120 and the common voltage lines Vcom_OL, Vcom_EL may be supplied with the common voltage from the common voltage driver 130".

Figure 6:
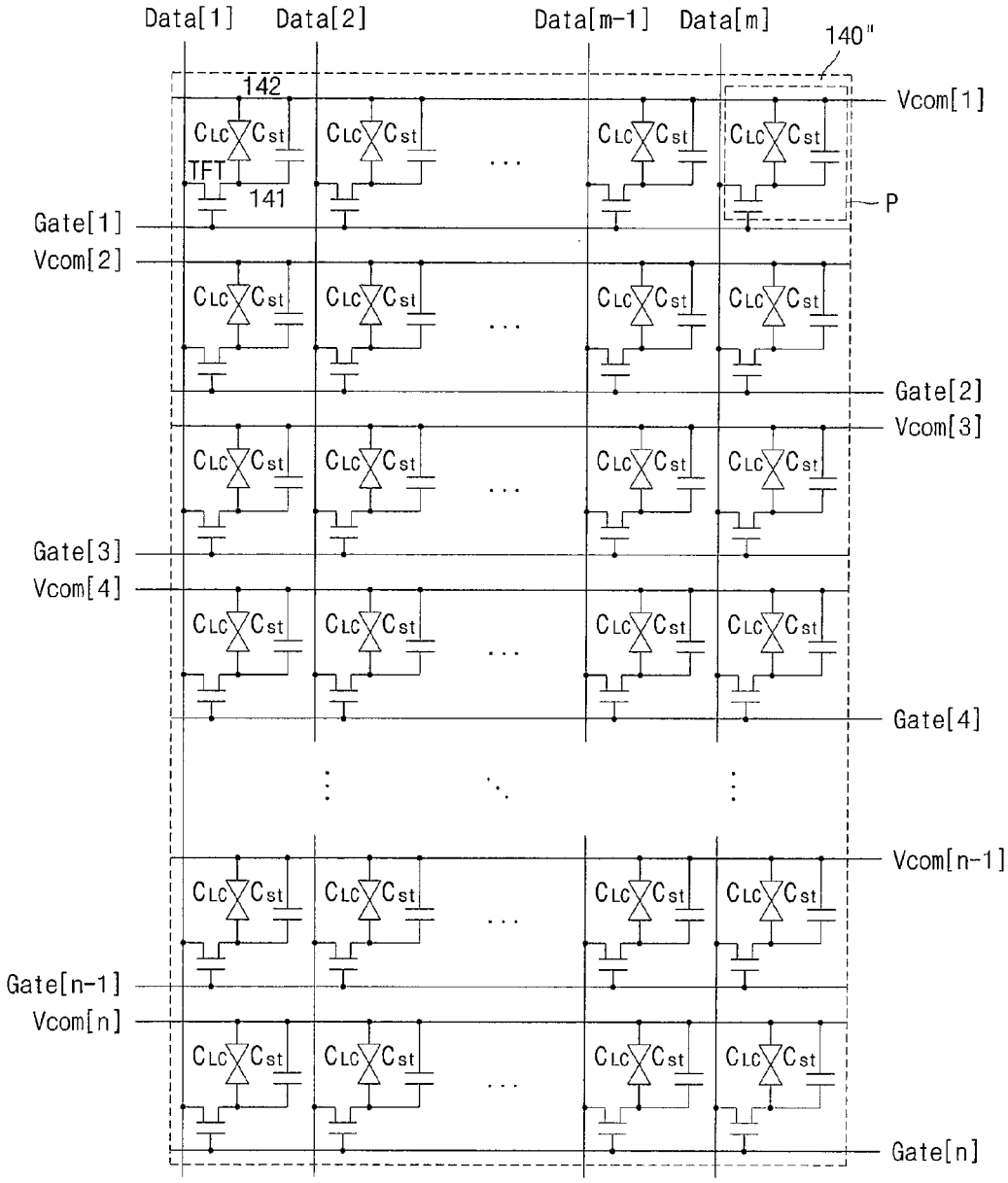
FIG. 6 is a circuit diagram illustrating the pixels in the liquid crystal display of FIG. 5 as an equivalent circuit.

Referring to FIG. 6, there is presented a circuit diagram illustrating the pixels on the liquid crystal display of FIG. 5 as an equivalent circuit.

Each of the plurality of pixels on the liquid crystal display of FIG. 6 includes a TFT, a liquid crystal element $C_{LC}$ and a storage capacitor $C_{st}$.

The TFT includes a gate electrode, a first electrode and a second electrode. The gate electrode is coupled to a corresponding one of the plurality of gate lines Gate [1], Gate [2], . . . , Gate [n], the first electrode (a drain electrode or a source electrode) is coupled to a corresponding one of the plurality of data lines Data [1], Data [2], . . . , Data [m], and the second electrode (a source electrode or a drain electrode) is coupled to a pixel electrode 141. The TFT is turned on when a high level of gate voltage is applied to the gate electrode to transfer the data voltage from the data lines Data [1], Data [2], . . . . Data [m] to the pixel electrode 141.

The liquid crystal element $C_{LC}$ includes a first electrode and a second electrode. The first electrode is electrically coupled to the pixel electrode 141 and the second electrode is coupled to a common electrode 142. The liquid crystal element $C_{LC}$ controls the amount of light transmitted or shields light by changing the arrangement of liquid crystal molecules with an electric field in a liquid crystal layer therein. The electric field is generated when the data voltage is applied to the pixel electrode 141 and the common voltage Vcom is applied from the common voltage supplier 130". The storage capacitor $C_{st}$ includes a first electrode and a second electrode. The first electrode is coupled to the pixel electrode 141 and the second electrode is electrically coupled to the common electrode 142. In other words, the storage capacitor $C_{st}$ is coupled to the liquid crystal element $C_{LC}$ in parallel. When a high level of gate voltage is applied to the gate electrode of the TFT, the TFT is turned on. When the TFT is turned on, the data voltage is applied to the pixel electrode 141 and the storage capacitor $C_{st}$ stores an amount of charge equal to the voltage difference between the pixel electrode 141 and the common electrode 142. When the TFT is turned off, the amount of charge that was previously stored in the storage capacitor $C_{st}$ is supplied to the pixel electrode 141, thereby maintaining the operation of the liquid crystal element.

Figure 7A:
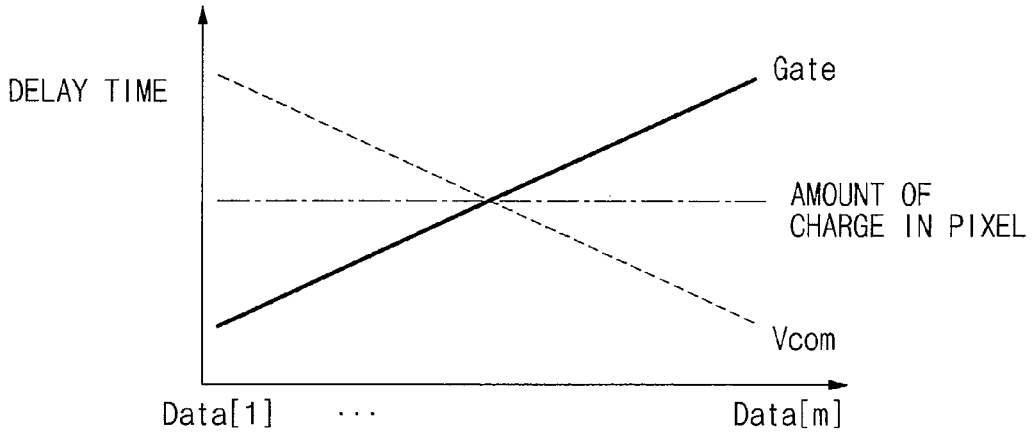
FIG. 7*a* is a graph illustrating the relationship between a data line coupled to odd pixels in the liquid crystal display of FIG. 5 and the amount of charge in the odd pixels.
Figure 7B:
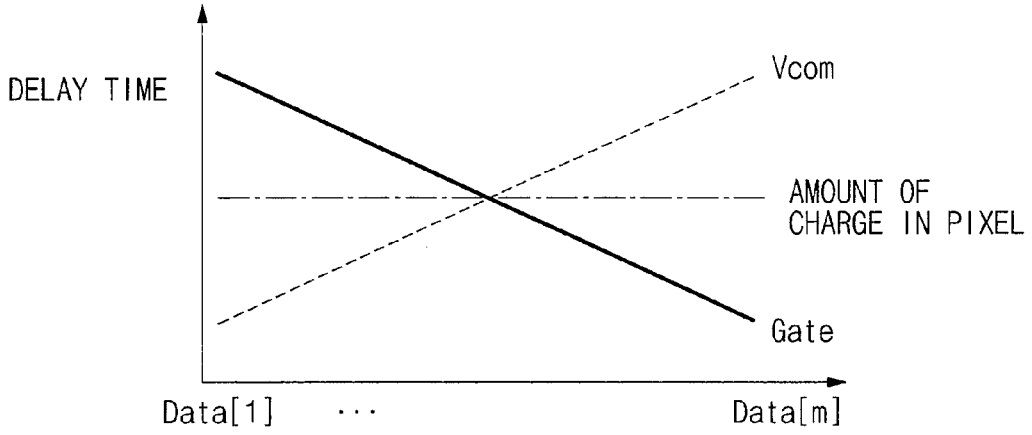
FIG. 7*b* is a graph illustrating the relationship between a data line coupled to even pixels in the liquid crystal display of FIG. 5 and the amount of charge in the even pixels.

Referring to FIGS. 7*a* and 7*b*, there are presented graphs illustrating the relationship between the data line coupled to the pixel in the liquid crystal display of FIG. 5 and the amount of charge in the pixel.

FIG. 7*a* is a graph illustrating the amount of charge in the odd pixels coupled to the odd gate lines Gate [1], Gate [3], . . . , Gate [n−1]. The pixels are coupled to the data lines Data [1], Data [2], . . . , Data [m] extended in the first direction and the odd gate lines Gate [1], Gate [3], . . . , Gate [n−1] and the odd common voltage lines Vcom_OL extended in the second direction between the first side and the second side of the liquid crystal display and crossing the plurality of data lines. Here, the odd gate lines extend from near the first side toward the second side, and the odd common voltage lines Vcom_OL extend from near the second side toward the first side.

Referring to the amount of charge in the odd pixels, the delay time of the gate voltage applied to the pixels coupled to the first data line Data [1] is shorter than that of the gate voltage applied to the pixels coupled to other data lines Data [2], Data[3], . . . , Data [m], and the delay time of the common voltage is longer than that of the common voltage applied to the pixels coupled to other data lines Data [2], Data [3], . . . , Data [m]. Additionally, the delay time of the gate voltage applied to the pixels coupled to the m data line Data [m] is longer than that of the gate voltage applied to the pixels coupled to other data lines Data [1], Data[2], . . . , Data [m−1], and the delay time of the common voltage is shorter than that of the common voltage applied to the pixels coupled to other data lines Data [1], Data [2], . . . , Data [m−1].

Here, the difference between the delay time of the gate voltage applied to the pixels coupled to the first data line Data [1] and the delay time of the gate voltage applied to the pixels coupled to the m data line Data [m] is substantially the same as the difference between the delay time of the common voltage applied to the pixels coupled to the first data line Data [1] and the delay time of the common voltage applied to the pixels coupled to the m data line Data [m]. In other words, the delay time of the gate voltage applied to the pixels coupled to the first data line Data [1] is compensated by the delay time of the common voltage. Likewise, the delay time of the common voltage applied to the pixels coupled to the m data line Data [m] is compensated by the delay time of the gate voltage so that each of the pixels has substantially the same amount of charge. Accordingly, the delay time of the gate voltage and the delay time of the common voltage mutually compensate for each other for each of the pixels coupled to any of the plurality of data lines. The pixels having substantially the same amount of charge may prevent or reduce afterimage phenomena and remaining voltage caused by non-uniform amounts of charge in each of the pixels. In one embodiment, since the common voltage lines Vcom_OL and the odd gate lines Gate [1], Gate [3], . . . , Gate [n−1] use the same metal line with the same delay characteristics during fabrication, the delay time corresponding to the distance is substantially the same.

FIG. 7*b* is a graph illustrating the amount of charge in the even pixels coupled to the even gate lines Gate [2], Gate [4], . . . , Gate [n]. The pixels are coupled to the plurality of data lines Data [1], Data [2], . . . , Data [m] extended in the first direction and the even gate lines Gate [2], Gate [4], . . . , Gate [n] and the even common voltage lines Vcom_EL extended in the second direction between the first side and the second side of the liquid crystal display and crossing the plurality of data lines. Here, the even gate lines extend from near the second side toward the first side, and the even common voltage lines Vcom_EL extend from near the second side toward the first side.

Referring to the amount of charge in the even pixels, the delay time of the gate voltage applied to the pixels coupled to the first data line Data [1] is longer than that of the gate voltage applied to the pixels coupled to other data lines Data [2], Data[3], . . . , Data [m], and the delay time of the common voltage is shorter than that of the common voltage applied to the pixels coupled to other data lines Data [2], Data [3], . . . , Data [m]. Additionally, the delay time of the gate voltage applied to the pixels coupled to the m data line Data [m] is shorter than that of the gate voltage applied to the pixels coupled to other data lines Data [1], Data[2], . . . , Data [m−1], and the delay time of the common voltage is longer than that of the common voltage applied to the pixels coupled to other data lines Data [1], Data [2], . . . , Data [m−1].

Here, the difference between the delay time of the gate voltage applied to the pixels coupled to the first data line Data [1] and the delay time of the gate voltage applied to the pixels coupled to the m data line Data [m] is substantially the same as the difference between the delay time of the common voltage applied to the pixels coupled to the first data line Data [1] and the delay time of the common voltage applied to the pixels coupled to the m data line Data [m]. In other words, the delay time of the gate voltage applied to the pixels coupled to the first data line Data [1] is compensated by the delay time of the common voltage. Likewise, the delay time of the common voltage applied to the pixels coupled to the m data line Data [m] is compensated by the delay time of the gate voltage so that each of the pixels has substantially the same amount of charge. Accordingly, the delay time of the gate voltage and the delay time of the common voltage mutually compensate for each other for each of the pixels coupled to any of the plurality of data lines. The pixels having the same amount of charge may prevent or reduce afterimage phenomena and remaining voltage caused by non-uniform amounts of charge in each of the pixels. In one embodiment, since the common voltage lines Vcom_EL and the even gate lines Gate [2], Gate [4], . . . , Gate [n] use the same metal line with the same delay characteristics during fabrication, the delay time corresponding to the distance is substantially the same.

As described above, the liquid crystal display according to exemplary embodiments of the present invention may prevent or reduce generation of afterimage phenomena and remaining voltage caused by non-uniform amounts of charge in each of the pixels by uniformly maintaining the charge in the pixels.

The above description only corresponds to exemplary embodiments for implementing the liquid crystal display according to exemplary embodiments of the present invention, and thus the present invention is not limited thereto. Accordingly, it would be appreciated by those skilled in the art that changes might be made in this embodiment without departing from the principles and spirit of the invention, the scope of which is defined in the claims and their equivalents.

What is claimed is:

1. A liquid crystal display comprising:

a plurality of data lines extending in a first direction;

a single gate driver for supplying all gate voltages;

a single common voltage supplier for directly supplying a common voltage to a plurality of pixels;

a plurality of gate lines extending in a second direction between a first side and a second side of the liquid crystal display and crossing the data lines, the gate lines comprising even gate lines and odd gate lines, the even gate lines coupled to the single gate driver at a first side of the single gate driver and the odd gate lines coupled to the single gate driver at a second side of the single gate driver and opposite the location where the even gate lines are coupled; and a plurality of common voltage lines crossing the data lines and parallel with the gate lines, the common voltage lines comprising even common voltage lines that are all electrically connected together and odd common voltage lines that are all electrically connected together, the odd common voltage lines coupled to the single common voltage supplier at only a location proximate to the first side and the even common voltage lines coupled to the single common voltage supplier at only a location proximate to the second side and opposite the location where the odd common voltages lines are coupled, wherein the single common voltage supplier is configured to supply the common voltage having a same level concurrently to all of the common voltage lines in the liquid crystal display.

2. The liquid crystal display as claimed in claim 1, wherein the odd gate lines are configured to transfer the gate voltage from near the second side toward the first side and the even gate lines are configured to transfer the gate voltage from near the first side toward the second side.

3. The liquid crystal display as claimed in claim 1, wherein the odd gate lines are configured to transfer the gate voltage from near the first side toward the second side and the even gate lines are configured to transfer the gate voltage from near the second side toward the first side.

4. The liquid crystal display as claimed in claim 1, wherein the odd common voltage lines are configured to transfer the common voltage from near the first side toward the second side and the even common voltage lines are configured to transfer the common voltage from near the second side toward the first side.

5. The liquid crystal display as claimed in claim 1, further comprising a plurality of pixels, each of the plurality of pixels coupled to one of the plurality of data lines, one of the plurality of gate lines, and one of the plurality of common voltage lines, and configured to receive a data voltage, the gate voltage, and the common voltage to operate a liquid crystal element therein.

6. The liquid crystal display as claimed in claim 5, wherein each of the plurality of pixels is located at an area where said one of the plurality of data lines is orthogonal to said one of the plurality of gate lines and said one of the plurality of common voltage lines.

7. The liquid crystal display as claimed in claim 5, wherein each of the plurality of pixels comprises:

a thin film transistor coupled between said one of the plurality of data lines and a pixel electrode;

the liquid crystal element coupled between the pixel electrode and a common electrode; and a storage capacitor coupled between the pixel electrode and the common electrode.

8. The liquid crystal display as claimed in claim 7, wherein the thin film transistor comprises a control electrode coupled to said one of the plurality of gate lines, a first electrode coupled to said one of the plurality of data lines, and a second electrode coupled to the pixel electrode.

9. The liquid crystal display as claimed in claim 8, wherein the thin film transistor is turned on when the gate voltage is applied to the control electrode to apply the data voltage to the pixel electrode.

10. The liquid crystal display as claimed in claim 7, wherein the common electrode is coupled to said one of the plurality of common voltage lines.

11. The liquid crystal display as claimed in claim 5, wherein the gate voltage supplied by the even gate lines is applied from near the first side toward the second side and the odd gate lines is applied from near the second side toward the first side and the common voltage supplied by the even common voltage lines is applied from near the second side toward the first side and the odd common lines is applied from near the first side toward the second side to compensate for each other such that an amount of charge remains substantially uniform in each of the plurality of pixels.

12. The liquid crystal display as claimed in claim 11, wherein the amount of charge remains substantially uniform in the pixels near the first side and coupled to the even gate lines and the even common voltage lines, the gate voltage compensating for a delay of the common voltage supplied to the pixels near the first side.

13. The liquid crystal display as claimed in claim 12, wherein the amount of charge remains substantially uniform in the pixels near the second side and coupled to the even gate lines and the even common voltage lines, the common voltage compensating for a delay of the gate voltage supplied to the pixels near the second side.

14. The liquid crystal display as claimed in claim 13 wherein the amount of charge remains substantially uniform in the pixels near the first side and coupled to the odd gate lines and the odd common voltage lines, the common voltage compensating for a delay of the gate voltage supplied to the pixels near the first side.

15. The liquid crystal display as claimed in claim 14, wherein the amount of charge remains substantially uniform in the pixels near the second side and coupled to the odd gate lines and the odd common voltage lines, the gate voltage compensating for a delay of the common voltage supplied to the pixels near the first side.

16. A liquid crystal display comprising:

a plurality of data lines extending in a first direction;

a single gate driver for supplying all gate voltages;

a single common voltage supplier for directly supplying a common voltage to a plurality of pixels;

a plurality of gate lines extending in a second direction between a first side and a second side of the liquid crystal display and crossing the data lines, the gate lines comprising even gate lines and odd gate lines, the even gate lines coupled to the single gate driver at a second side of the single gate driver and the odd gate lines coupled to the single gate driver at a first side of the single gate driver and opposite the location where the even gate lines are coupled;

a plurality of common voltage lines crossing the data lines and parallel with the gate lines, the common voltage lines comprising even common voltage lines that are all electrically connected together and odd common voltage lines that are all electrically connected together, the odd common voltage lines coupled to the common single voltage supplier at only a location proximate to the second side and the even common voltage lines coupled to the single common voltage supplier at only a location proximate to the first side and opposite the location where the odd common voltages lines are coupled; and each of the plurality of pixels coupled to one of the plurality of data lines, one of the plurality of gate lines, and one of the plurality of common voltage lines and configured to receive a data voltage, the gate voltage, and the common voltage to operate a liquid crystal element therein, wherein the single common voltage supplier is configured to supply the common voltage having a same level concurrently to all of the common voltage lines in the liquid crystal display.

17. The liquid crystal display as claimed in claim 16, wherein the gate voltage supplied by the even gate lines is applied from near the second side toward the first side and the common voltage supplied by the even common voltage lines is applied from near the first side toward the second side to compensate for each other such that an amount of charge remains substantially uniform in each of the plurality of pixels.

18. The liquid crystal display as claimed in claim 17, wherein the gate voltage supplied by the even gate lines is applied from near the second side toward the first side and the common voltage supplied by the even common voltage lines is applied from near the first side toward the second side to compensate for each other such that an amount of charge remains substantially uniform in each of the plurality of pixels.

19. The liquid crystal display as claimed in claim 17, wherein the gate voltage supplied by the odd gate lines is applied from near the first side toward the second side and the common voltage supplied by the odd common voltage lines is applied from near the second side toward the first side to compensate for each other such that the amount of charge remains substantially uniform in each of the plurality of pixels.

* * * * *